US005303540A

United States Patent [19]

Rozenwasser

[11] Patent Number: 5,303,540

[45] Date of Patent: Apr. 19, 1994

[54] FINE JEWELRY DIAMOND CUT ROPE CHAIN AND METHOD OF MANUFACTURING SAME

[75] Inventor: David Rozenwasser, Savion, Israel

[73] Assignee: Avraham Moshe Rozenwasser, Savion, Israel

[21] Appl. No.: 987,744

[22] Filed: Dec. 8, 1992

[30] Foreign Application Priority Data

Oct. 1, 1992 [IL] Israel ..... 103324

[51] Int. Cl.[5] ..... B21L 5/02

[52] U.S. Cl. ..... 59/80; 59/82; 59/3; 59/35.1

[58] Field of Search ..... 59/3, 35.1, 29, 78, 59/80, 82, 83

[56] References Cited

U.S. PATENT DOCUMENTS

| | | | |
|---|---|---|---|
| 944,640 | 12/1909 | Ungerer et al. | 59/1 |
| 2,424,924 | 7/1947 | Chernow | 59/80 |
| 2,711,069 | 6/1955 | Armbrust | 59/35.1 |
| 4,268,946 | 5/1981 | Eisenberg | 29/424 |
| 4,716,750 | 1/1988 | Tizzi | 72/52 |
| 4,986,067 | 1/1991 | Caccialupi | 59/35.1 |
| 4,996,835 | 3/1991 | Rozenwasser | 59/83 |
| 5,125,225 | 6/1992 | Strobel | 59/80 |
| 5,129,220 | 7/1992 | Strobel | 59/80 |

FOREIGN PATENT DOCUMENTS

| | | | |
|---|---|---|---|
| 3533637 | 5/1986 | Fed. Rep. of Germany | 59/80 |
| 0260644 | 10/1988 | Japan | 59/35.1 |

*Primary Examiner*—David Jones
*Attorney, Agent, or Firm*—Helfgott & Karas

[57] ABSTRACT

A fine jewelry diamond cut rope chain comprising a double helix rope chain made from tightly interfitting links of precious metal, each link having a small gap formed therein so as to enable one of said links to pass through the gap of a second link, said links being intertwined to fit tightly one against another, characterized in that at least some of the links of the chain comprise a high luster diamond cut shallow band or strip extending along the surface of at least part of their outer perimeter. Precious metal wire chain links and methods of manufacture are also claimed.

21 Claims, 3 Drawing Sheets

FINE JEWELRY DIAMOND CUT ROPE CHAIN AND METHOD OF MANUFACTURING SAME

FIELD OF THE INVENTION

The present invention relates to novel fine jewelry diamond cut rope chains and to methods of manufacturing them. Specifically the invention is concerned with novel hollow diamond cut rope chains.

BACKGROUND OF THE INVENTION

Fine jewelry rope chains for necklaces and bracelets etc. have been known for a long time. The traditional rope chain, constructed from intertwined links soldered to one another has not changed basically over the past hundreds of years. Although rope chains are also manufactured by automatic machines, the tightly intertwined chains are still being manufactured to a great extent by hand. In my earlier patents U.S. Pat. Nos. 4,934,135 and 4,996,835, I disclosed and claimed rope chains and methods for preparing such rope chains having reduced weight and labor costs compared with conventional rope chains of the same chain diameter.

A particularly popular type of rope chain is commonly known as a diamond cut rope chain. Such a chain comprises flat cuts or facets on the outer perimeter of at least some of the chain links to provide a flat mirror finish surface which is very light reflective, making the chain sparkle. This diamond cut facet can easily be prepared on solid rope chains, i.e. chains made with solid links, by cutting or shaving a facet from the arced section of the link, as is well known in the art.

Conventional solid diamond cut (faceted) rope chains have facets generally cut about one third or more into the thickness of the chain link in order to obtain a reasonable size shiny surface, as illustrated in FIG. 1. The amount of precious metal sheared away to form this facet can account for up to 10% of the weight of the chain and although the metal shearings are collected and recycled, a significant amount of precious metal is nevertheless lost in the process. In the case of hollow rope chains, i.e. chains having hollow links, it is difficult to make diamond cut facets in the conventional way, since the outer plate of the hollow wire making up the chain link is very thin and can be as little as 0.05 mm thick, and any facet cut in the outer arced perimeter of the link would make a hole through this outer plate.

A recent patent to Strobel, U.S. Pat. No. 5,125,225, discusses the making of rope chains in general and hollow rope chains specifically and claims a method for manufacturing diamond cut hollow rope chains by wrapping a hollow rope chain about a lathe drum, freezing the drum, applying water to the chain to freeze it in place thereby immobilizing it, and advancing a blunt burnishing tool against the links of the chain by applying a plurality of incremental deformative thrusts of blunt force against some of the curved outer wall portions of the hollow links until this outer wall is deformed and pushed back towards the inner wall of the links, thus flattening portions of the curved outer wall. By rotating the lathe drum and advancing the blunt burnishing tool, additional links along the chain length receive flattened surfaces. According to this method, not all of the chain links have identical flattened area. The amount of flattened area of any link will depend on the particular position of the link in the chain when the blunt burnishing tool strikes it. Those links whose outer edge is closer to the blunt tool will have a larger flattened area, whereas the links that are further away from the blunt tool receive smaller increments of force and will therefore have smaller flattened areas. These flattened portions of the outer walls are then diamond cut to remove or shave off a very thin layer of metal (about 0.001 to 0.002 mm) to provide smooth and shiny facets without making any hole in the link. According to this patent, the hollow link undergoing the flattening process has one flat oval facet positioned approximately opposite the link gap, as illustrated in FIG. 5 of said patent, similar to conventional diamond cut solid rope chains shown in FIG. 1. The cross section of the faceted area is obviously deformed with respect to the cross-section of the rest of the chain link.

SUMMARY OF THE INVENTION

It is an object of the present invention to provide a novel fine jewelry diamond cut rope chain.

Another object of the invention is to provide a rope chain having high luster shallow diamond cut bands or strips on the outer circumference of the chain links.

Still another object is to provide rope chains with the hollow links having high luster shallow diamond cut bands or strips on their outer circumference.

Yet another object is to provide methods of manufacturing such fine jewelry high luster diamond cut rope chains.

A further object is to provide precious metal chain links with shallow high luster diamond cut bands or strips on their outer circumference.

A still further object is to provide methods for manufacturing fine jewelry hollow chain links having high luster diamond cut bands or strips on their outer circumference without deformation of the hollow link wire.

These and other objects are obtained by the present invention wherein a diamond cut high luster finish is provided on a very shallow band or strip, having a depth of only about 1/100 of the link wire thickness, significantly reducing loss of metal shavings. Moreover, the diamond cuts follow the contour of the link wire and only affect the outer surface of the chain links, keeping the inner cross-section of the link wire substantially uniform.

In accordance with the present invention there is provided a fine jewelry diamond cut rope chain comprising a double helix rope chain made from tightly interfitting hollow links of precious metal, each link having a small gap formed therein, so as to enable one of said links to pass through the gap of a second link, said links being intertwined to fit tightly one against the other, characterized in that at least some of the links comprise high luster diamond cut bands or strips along the surface of at least part of their outer perimeter.

In a preferred embodiment, all the links of the chain comprise diamond cut high luster bands or strips conforming to the curvature of the links. In another preferred embodiment, the diamond cut high luster band or strip extends along the length of the entire outer perimeter of each link. In a most preferred embodiment, the rope chain comprises hollow links.

The diamond cut rope chain of this invention is assembled by hand using chain links already having diamond cut bands or strips on the links and not as is the present practice of imparting facets to the link after the rope chain has been assembled.

Hollow links for making rope chains are generally prepared in the following manner. First, a hollow wire is prepared from a thin foil or plate of precious metal, for example gold, of indefinite length having a thickness of about 0.05–0.1 mm and a width slightly less than the outer circumference of the designated hollow wire cross-section. This is accomplished by drawing the length of the foil or plate through a die, for example a round die, together with a soft metal wire core, such as from copper or aluminum, so that the precious metal foil or plate wraps around the soft metal core as it is drawn through the die to form a tube. The cross section of the wire will correspond to the shape of the orifice of the die. Since the width of the foil or plate is smaller than the circumference of the soft metal core, a longitudinal gap is formed along the entire length of the gold tube. From this gold plated wire containing the soft metal core, chain links are made in a conventional manner. The soft metal core is then dissolved with strong acid, which penetrates via the longitudinal gap, leaving hollow gold chain links. Alternatively, the links with the core still inside can be assembled into a rope chain and the cores dissolved subsequently by immersing the chain in suitable acid. "Seamless" hollow chain links are made in a similar manner but without a longitudinal gap in the gold plating. The "seamless" links are not as practical to use, since it is more difficult to dissolve the inner soft metal core because of the small surface area available for contacting the acid.

In accordance with one aspect of the present invention, a precious metal foil or plate is first shaved along its length with a high speed rotating flat diamond cutting edge, forming a shallow smooth high luster band or strip in the foil or plate. This foil or plate is subsequently made into a hollow wire as described hereinbefore with the shallow high luster band or strip facing outwards. Chain links are produced from this wire by any conventional means. Each of the chain links thus comprises a diamond cut shallow high luster band or strip contrasted against a less shiny outer perimeter of the link. The hollow wire inner cross section remains the same throughout each link. The width of the diamond cut band or strip can vary depending on the length of the cutting edge of the high speed rotating diamond cutting tool. The depth of the band or strip etched into the foil or plate may also vary, but preferably is between 0.005–0.04 mm, and most preferably between 0.01–0.02 mm. This, of course, also depends on the thickness of the foil or plate. The specific depth is immaterial as long as the chain link retains sufficient strength in its wall so that it can be used in preparing hollow link rope chains. Alternatively, the diamond cut high luster band or strip can be shaved directly from the surface of a precious metal coated wire while it still contains the non-precious metal core prior to dissolving it. This is accomplished by pulling the precious metal wire past a high speed rotating diamond cutting head having a curved cutting edge contoured to conform with the perimeter of the precious metal wire cross section. As the wire passes the curved diamond cutting edge, a very shallow curved high luster band or strip is shaved from the outer surface of the precious metal wire along its longitudinal axis having the same curve as the wire perimeter cross-section. Chain links can be prepared from this diamond cut wire having high luster bands or strips along the entire outer circumference.

Rope chains made from links according to this invention have highly reflective diamond cut bands or strips along their outer perimeter providing a contrasting sparkling fine jewelry chain. One advantage of the present invention is that the chains can be made without any appreciable additional manufacturing costs, since the only additional step beyond the conventional ones for preparing links is the diamond cutting step of the precious metal wire or plate, and this requires only conventional apparatus generally found in gold chain manufacturing enterprises. In accordance with this invention, it is also possible to have more than one strip shaved along the outer circumference of the link, providing chains with links having one, two or more high luster strips, giving different sparkling effects.

BRIEF DESCRIPTION OF THE DRAWINGS

The invention will now be discussed with reference to the drawings, in which.

DETAILED DESCRIPTION OF THE INVENTION

Figure 1:
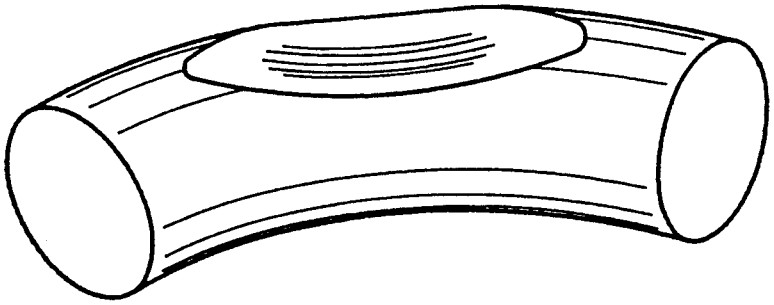
FIG.1 PRIOR ART
FIG. 1 illustrates a prior art chain link section with a diamond cut facet.
Figure 2:
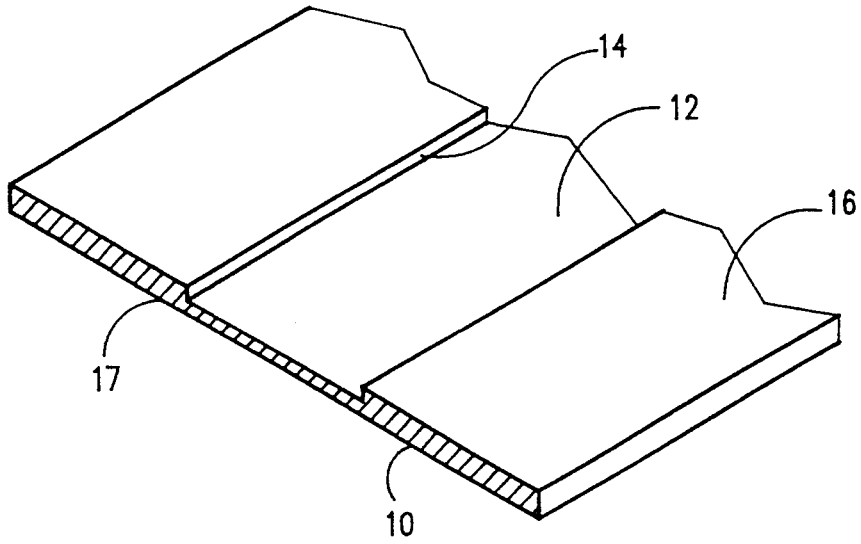
FIG. 2 is an enlarged cross-sectional view of a diamond cut precious metal foil from which a hollow chain wire is made to provide links in accordance with this invention.

Referring now to FIG. 2, there is illustrated a blown up cross-section of a thin plate of precious metal 10 having a diamond cut strip 12 shaved along its axial length. The strip is shaved by passing the plate under a high speed rotating diamond cutting head rotating at about 8,000 to 20,000 r.p.m. The depth 14 of this shaved strip 12 can be minimal, generally between 0.01 to 0.02 mm or more, the criteria being that it provides a diamond cut section only on one side of the plate having a highly reflective surface which contrasts with the rest of the surface 16 of that side of the plate 10 without deforming the unshaven side 17 of the plate.

Figure 3:
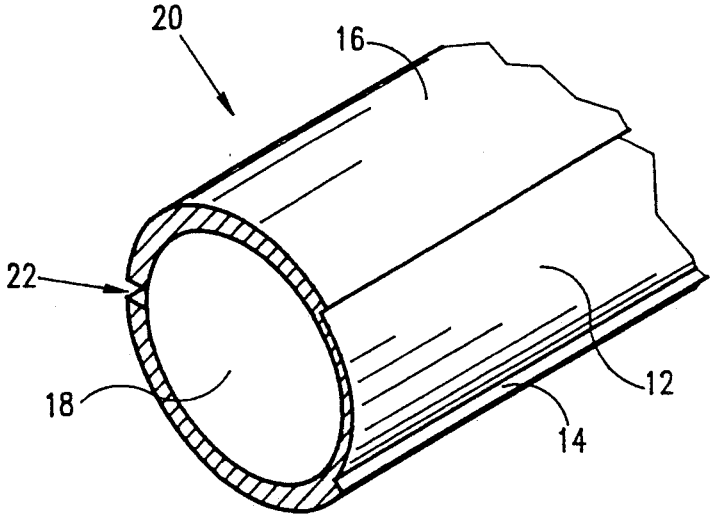
FIG. 3 is an enlarged sectional view of a hollow wire made from a metal sheet of FIG. 2.
Figure 4:
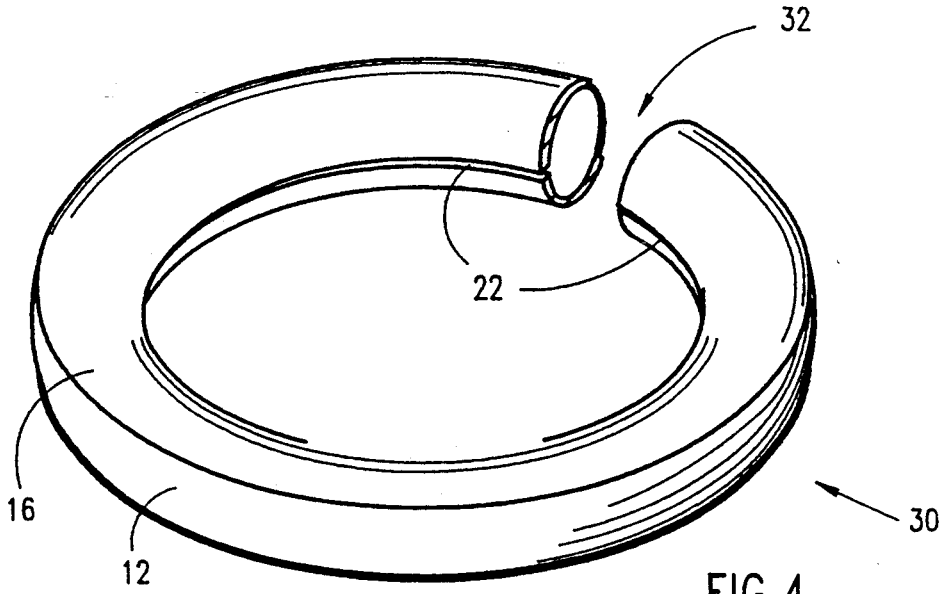
FIG. 4 is an enlarged view of a hollow chain link in accordance with a preferred embodiment of the invention.
Figure 5:
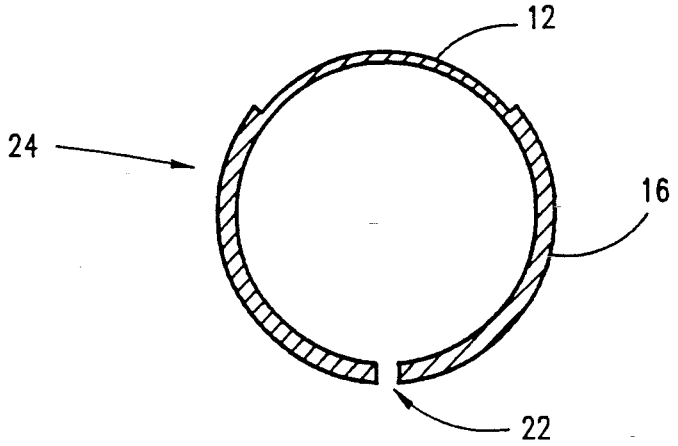
FIG. 5 is an enlarged cross-sectional view of the link of FIG. 4.

The metal sheet 10 is then drawn through a round die together with a soft metal wire core 18, to produce a precious metal plated wire 20 (FIG. 3) with outer surface 16 and reflective strip 12. The width of the sheet 10 is generally 15–20% smaller than the circumference of the soft metal core 18, thereby producing a gap 22 in the precious metal envelope covering the core 18 along the entire length of the drawn wire. The purpose of this gap 22 is to provide a large surface area for acid to come in contact with the soft metal core 18 and dissolve it, leaving a hollow precious metal wire. Chain links are prepared from wire 20 in a conventional manner by winding the wire 20 into a coil and cutting the wire before each complete turn, forming a skewed link with a gap 32 (see FIG. 4). The link is then unskewed for use in assembling a rope chain. This gap 32 is slightly larger than the outer diameter of the hollow wire forming link 30, so that one link can be fitted into another via the gap 32. The links are then immersed in the appropriate acid to dissolve the soft metal core 18 leaving a hollow chain link with a high luster diamond cut strip on its outer perimeter.

Figure 7:
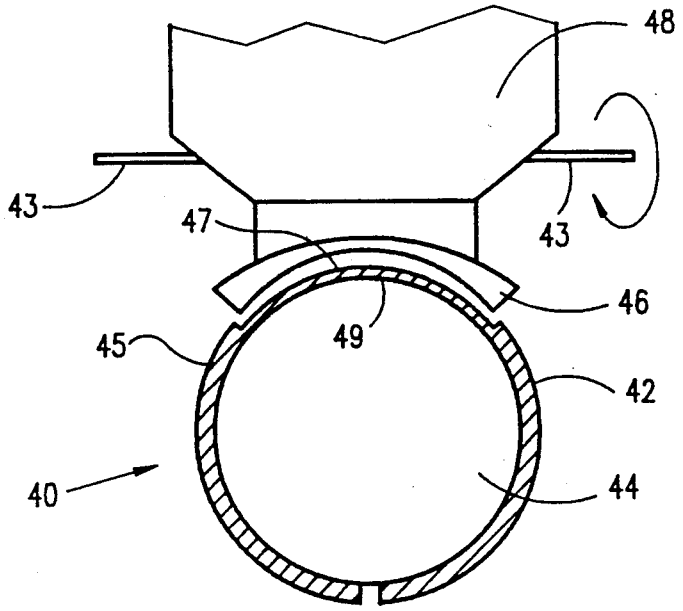
FIG. 7 schematically illustrates a process for diamond cutting high luster bands or strips on precious metal wire according to another embodiment of the invention.

FIG. 7 schematically shows an alternative way of preparing diamond cut strips on precious metal wire. When the metal wire 40, shown here in cross section, from which chain links are made, is still in the wire stage, with the precious metal plating 42 covering a non precious metal core 44, such as from aluminum or copper, the wire 40 is pulled past a curved diamond cutting edge 46 mounted on a cutting head 48 revolving around axis 43 at very high speed. The diamond cutting edge 46 is contoured in the shape of the surface 45 of the precious metal plating 42. The shaved diamond cut area 47 thus produced as the wire 40 is pulled past the cutting edge 46 is a thin strip running along the length of outer surface of the wire 40. By raising and lowering the cutting edge 46, sections of diamond cut strips can be shaved along the wire. The inner plate surface 49 is unaffected. The wire can then be converted to chain links, each link having a high luster diamond cut strip along its outer perimeter.

Figure 6:
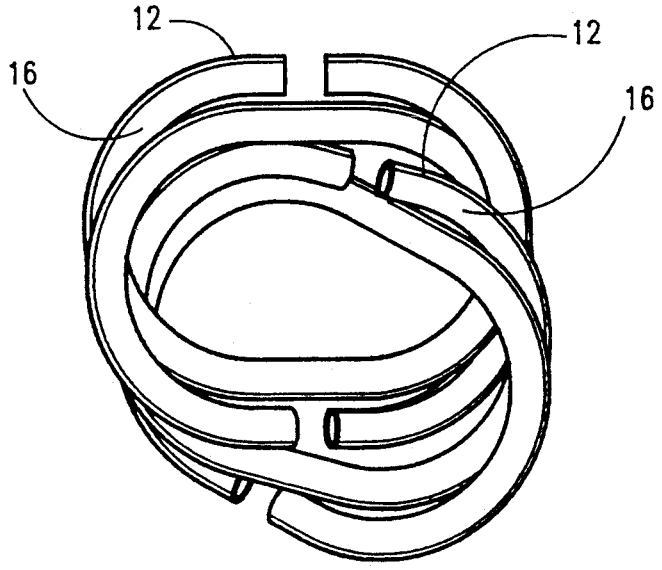
FIG. 6 illustrates a section of a rope chain in accordance with a preferred embodiment of the present invention made with elongated hollow chain links.

A rope chain is assembled with these links in a conventional manner by tightly intertwining the chain links one within the other and twisting them to produce a double helix rope chain. Such a rope chain is illustrated in FIG. 6, having a diamond cut strip 12 encompassing the entire outer perimeter of each link. The contrast in light reflectivity between the outer surface 16 of the link and the diamond cut strip 12 gives a sparkling effect to the chain comparable to a classical diamond cut rope chain. One advantage, of course, of the present invention is that diamond cut high luster hollow rope chains can be easily prepared which are considerably less expensive because of their lighter weight.

In accordance with this invention it is also possible to make diamond cut high luster rope chains with alternating rings, some having shaved diamond cut strips and others not, for example a chain with every second or third link having a sparkling diamond cut strip.

Figure 8:
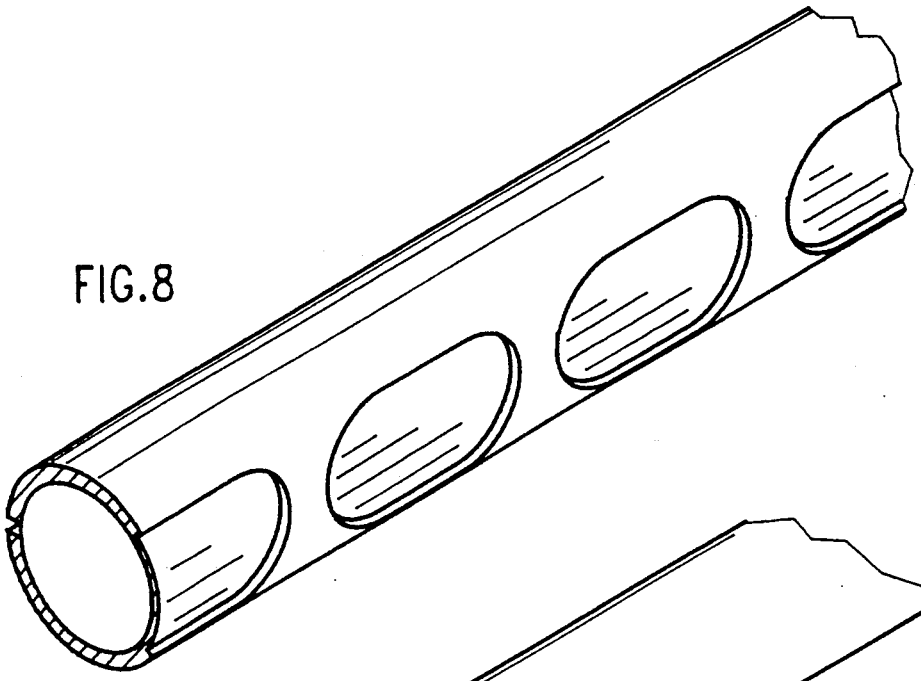
FIGS. 8 and 9 are perspective enlarged views of hollow wires with varying shaped high luster diamond cut strips.
Figure 9:
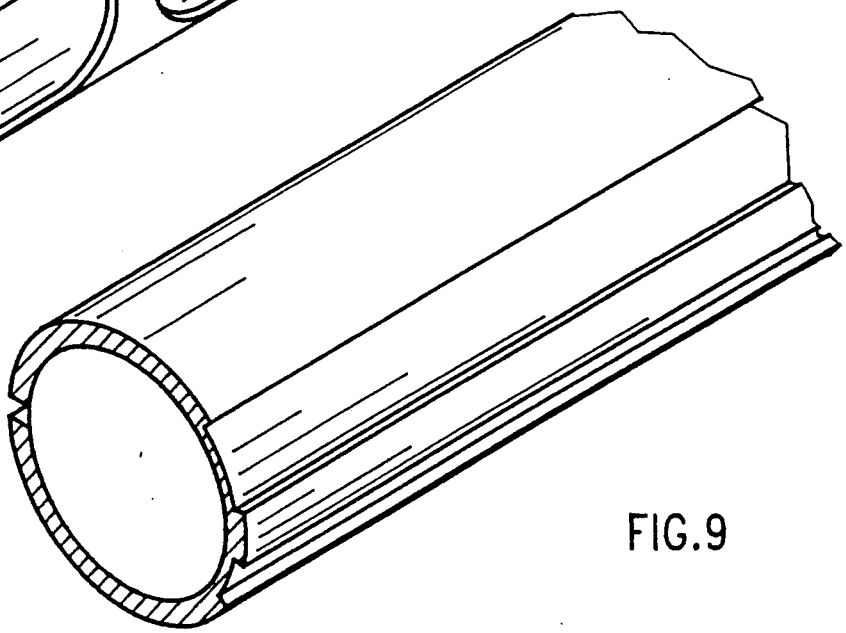

Other possibilities within the framework of this invention are shown in FIGS. 8 and 9. Thus, one can provide links having high luster diamond cut strips on only part of the link (FIG. 8) or one can shave strips in shapes other than linear, such as zigzag or star shaped, or provide multiple parallel strips (FIG. 9). This can be accomplished inter alia by diamond cutting the precious metal plate surface discontinuously with short alternating intervals or by simultaneously moving the plate or wire laterally under the diamond cutting edge as well as longitudinally or by using specialized diamond cutting edges.

The precious metal wire, both solid and hollow, used for this invention may have any geometric cross-section which will depend on the shape of the orifice in the die through which the precious metal wire is drawn. Such shapes may be round, oval, elongated, triangular, hexagonal, rhombic, octagonal or irregular, as disclosed in my previous U.S. Pat. No. 4,996,835.

It should be understood, of course, that the foregoing disclosure relates to only a preferred embodiment of the invention and that it is intended to cover all changes and modifications of the examples of the invention herein chosen for the purpose of the disclosure, which modifications do not constitute departures from the spirit and scope of the invention.

I claim:

1. A fine jewelry diamond cut rope chain comprising a double helix rope chain made from tightly interfitting links of precious metal link wire, each link having a small gap formed therein so as to enable one of said links to pass through the gap of another link, said links being intertwined to fit tightly one against another, at least some of the links of the chain having at least one high luster diamond cut surface provided in a shallow, generally elongate, outwardly open, diamond cut depression of a predetermined width formed in a link and extending along at least part of an outer perimeter of said link.

2. A fine jewelry diamond cut rope chain as in claim 1 wherein said chain links are hollow.

3. A fine jewelry diamond cut rope chain as in claim 1 wherein said high luster diamond cut surface is also curved to conform with a curvature of the cross-section of a link wire.

4. A fine jewelry diamond cut rope chain as in claim 1 wherein all the links of the chain comprise said high luster diamond cut surfaces.

5. A fine jewelry diamond cut rope chain as in claim 2 wherein said high luster diamond cut surface is also curved to conform with a curvature of the cross-section of a link wire.

6. A fine jewelry diamond cut rope chain as in claim 2 wherein all the links of the chain comprise diamond cut surfaces.

7. A fine jewelry diamond cut rope chain as in claim 1, wherein said depression is of a uniform width.

8. A chain link of precious metal for making jewelry rope chains having a high luster diamond cut surface, provided in a shallow, generally elongate, diamond cut depression of a predetermined width formed in an outer face of the link and extending along at least part of an outer perimeter thereof.

9. A chain link as in claim 8 wherein said high luster diamond cut surface is curved to conform with a curvature of the cross-section of a link wire.

10. A chain link as in claim 8 wherein the diamond cut surface extends along the entire length of the outer perimeter.

11. A chain link as in claim 8, which is hollow.

12. A chain link as in claim 9, which is hollow.

13. A chain link as in claim 10, which is hollow.

14. A chain link as in claim 8, wherein said depression is of a uniform width.

15. A method for manufacturing chain links for making rope chains having high luster diamond cut strips on their surface, the method comprising:

a) shaving a precious metal plate with a high speed rotating diamond edge cutting tool to provide a high luster longitudinal strip on a surface thereof, b) passing said plate together with a soft metal wire core through a die to make a precious metal plated wire having a high luster diamond cut strip extending lengthwise on the surface thereof, and c) forming chain links from said precious metal plated wire.

16. A method as in claim 15, and further comprising making a hollow rope chain from said chain links by tightly intertwining said links and soldering them together, and removing the soft metal core from the links to produce a hollow chain.

17. A method as in claim 15 and comprising a subsequent step of removing the core from said links to produce hollow chain links.

18. A method for manufacturing chain links for making rope chains having high luster surfaces, comprising the following steps:

rotating a curved diamond cutting edge of predetermined curvature at a high speed;

contacting an axially moving precious metal wire with the rotating diamond cutting edge and shaving from an outer surface of said wire a shallow, generally elongate depression of a predetermined width along a length of the wire so as to form a high luster diamond cut surface in said depression; and forming said wire into chain links with said depression disposed in an outer circumference of each link.

19. A method as in claim 18 wherein the precious metal wire comprises a soft metal inner core, the method further comprising:

a step of removing the metal inner core from the wire prior to said forming step.

20. A method as in claim 18 wherein the diamond cutting edge is shaped so as to form in said depression said high luster diamond cut surface having a curvature corresponding to a curvature of the cross-section of the wire.

21. A method as in claim 12 wherein the precious metal wire comprises a soft metal inner core, the method further comprising a step of removing said metal inner core from the wire subsequent to the forming step.

* * * * *